US006960089B2

(12) United States Patent
Lee et al.

(10) Patent No.: US 6,960,089 B2
(45) Date of Patent: Nov. 1, 2005

(54) SERIAL ATA CONNECTOR WITH RIGHT ANGLE CONTACT

(75) Inventors: George Lee, Irvine, CA (US); William E. Spink, Jr., Laguna Niguel, CA (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 10/632,478

(22) Filed: Aug. 1, 2003

(65) Prior Publication Data

US 2005/0026472 A1 Feb. 3, 2005

(51) Int. Cl.[7] ..... H01R 12/00
(52) U.S. Cl. ..... 439/79; 439/660; 439/924.1
(58) Field of Search ..... 439/79, 660, 924.1, 439/108, 101, 736, 606, 636–637, 65, 74, 95, 733.1, 502, 247, 353, 570, 80–83

(56) References Cited

U.S. PATENT DOCUMENTS 5,057,027 A * 10/1991 Yamada et al. ..... 439/83
5,626,482 A * 5/1997 Chan et al. ..... 439/74
5,873,742 A * 2/1999 McHugh ..... 439/74
5,971,800 A * 10/1999 Azuma et al. ..... 439/502
6,024,608 A * 2/2000 Azuma et al. ..... 439/660
6,045,408 A * 4/2000 Takemasa ..... 439/660
6,095,824 A * 8/2000 McHugh ..... 439/74
6,155,886 A * 12/2000 Koseki et al. ..... 439/736
6,447,340 B1 9/2002 Wu

* cited by examiner

*Primary Examiner*—P. Austin Bradley
*Assistant Examiner*—Edwin A. Leon
(74) *Attorney, Agent, or Firm*—Wei Te Chung

(57) ABSTRACT

A SATA connector (300) for being soldered to a printed circuit board (PCB) includes an insulative housing (70), a plurality of right angle contacts (80), and a pair of board locks (90). The insulative housing has a top wall (700), a bottom wall (701), a pair of side walls (702) and a rear wall (709) which together define a mating space (703), an L-shaped tongue (704) extends from the rear wall and into the mating space. Each contact has an engaging portion (802) retained in the L-shaped tongue and a solder portion (803) extending beyond the rear wall and bent in right angle so as to parallel to the rear wall adapted for being soldered to the PCB. The pair of board locks is mounted to the bottom wall of the housing.

1 Claim, 6 Drawing Sheets

SERIAL ATA CONNECTOR WITH RIGHT ANGLE CONTACT

CROSS-REFERENCE TO RELATED APPLICATIONS

The subject matter of this patent application is pertinent to contemporaneously filed U.S. Patent Applications entitled "SERIAL ATA CONNECTOR WITH COMPLIANT CONTACT" and entitled "SERIAL ATA CABLE ASSEMBLY", all invented by the same inventor and assigned to the same assignee as this patent application.

BACKGROUND OF THE INVENTION

1. Field of the Invention

The present invention generally relates to a Serial Advanced Technology Attachment (SATA) connector, and more particularly to a SATA connector having right angle contacts.

2. Description of Related Art

Currently, most computers have a storage device called a hard drive. A hard drive is connected to the computer by way of an interface, usually a controller card, a cable, and some software protocols. One type of hard drive interface used today is an integrated drive electronics (IDE) interface. This is also known as an advanced technology attachment (ATA) interface. ATA is the actual interface specification for the IDE standard. The current IDE/ATA standard is a parallel interface whereby multiple bits of data are transmitted at one time across the interface simultaneously during each transfer. A parallel interface allows for high throughput, however, as the frequency of the interface is increased, signaling problems and interference between signals become common.

Serial Advanced Technology Attachment (SATA) is an interface specification that abandons the parallel concept in favor of a serial interface where only one bit is transferred at a time. This allows the interface to operate at higher speeds without the problems associated with a parallel interface at higher speeds. As computer processor performance has increased, so have the read/write data rates of hard disk drive heads and media. SATA eliminates bottlenecks that occur in parallel AT interfaces.

Currently, serial ATA connectors are only single position seven pin connectors. Today, not only are processor speeds increasing, but the amount of space that a computer fits into is shrinking. Therefore, the motherboards or printed circuit boards (PCB) that hold the electronics and other devices for a computer have limited space. In a computer which may contain multiple hard drives, multiple SATA connectors and SATA cable assemblies may need to reside on the printed circuit board and occupy the space of the computer. This takes up considerable space, depending on the number of hard disk drives and associated SATA connectors.

Therefore, there is a need for integrating overall SATA connector interfaces into one interface that saves computer space and simplifies the assembly and manufacturing of the SATA connector.

SUMMARY OF THE INVENTION

An object of the present invention is to provide a SATA connector for saving computer space.

Another object of the present invention is to provide a SATA connector for achieving a more reliable high speed signals and low speed signals transmission.

In order to achieve the objects set forth, a SATA connector in accordance with the present invention for being soldered to a printed circuit board (PCB) comprises an insulative housing, a plurality of right angle contacts, and a pair of board locks. The insulative housing has a top wall, a bottom wall, a pair of side walls and a rear wall which together define a mating space, an L-shaped tongue extending from the rear wall and into the mating space. Each contact has an engaging portion retained in the L-shaped tongue and a solder portion extending beyond the rear wall and bent in right angle so as to parallel to the rear wall adapted for being soldered to the PCB. The pair of board locks is mounted to the bottom wall of the housing.

Other objects, advantages and novel features of the invention will become more apparent from the following detailed description when taken in conjunction with the accompanying drawings.

DETAILED DESCRIPTION OF THE INVENTION

Figure 1:
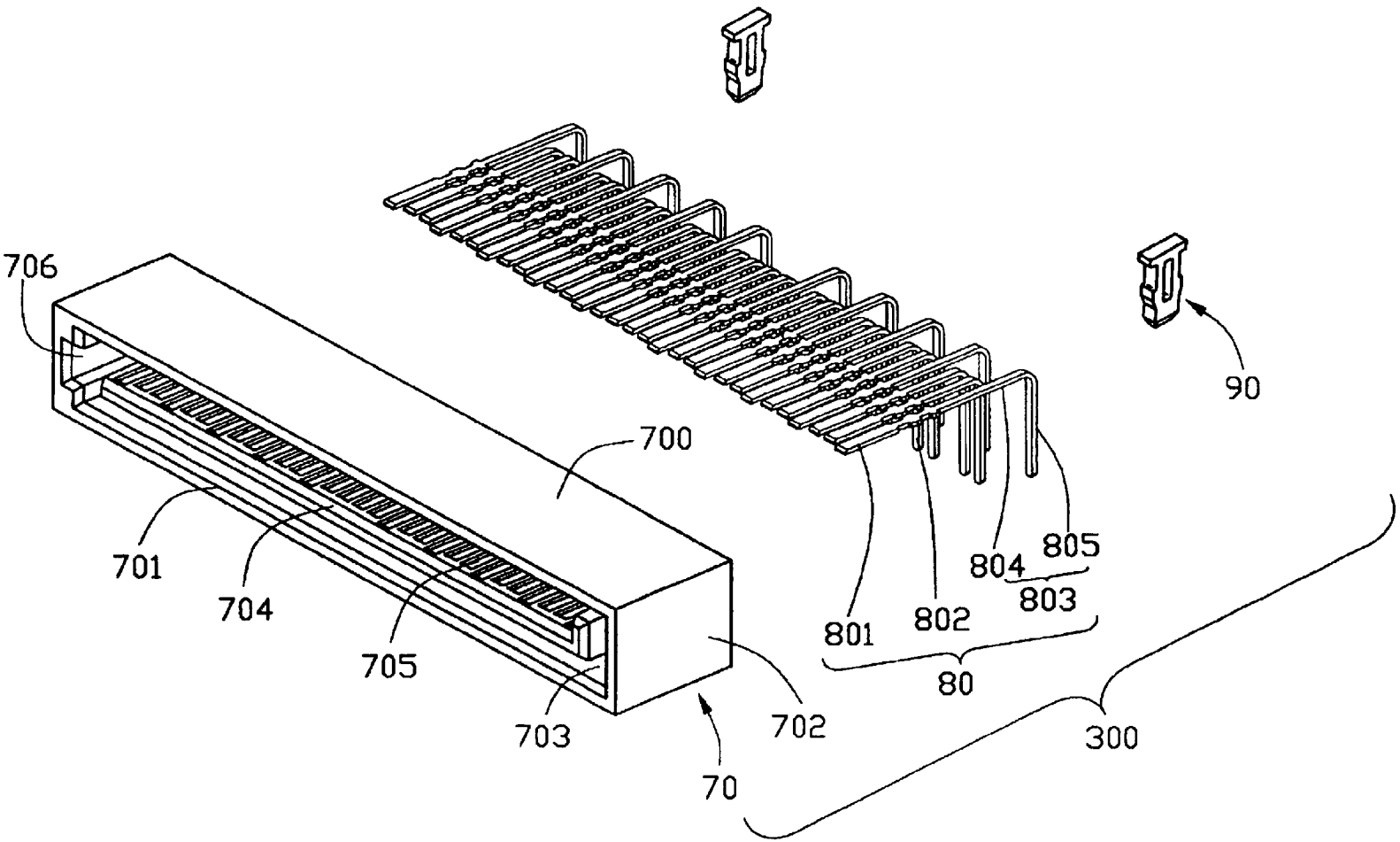
FIG. 1 is an exploded, perspective view of a SATA connector with right angle contacts in accordance with the present invention.
Figure 2:
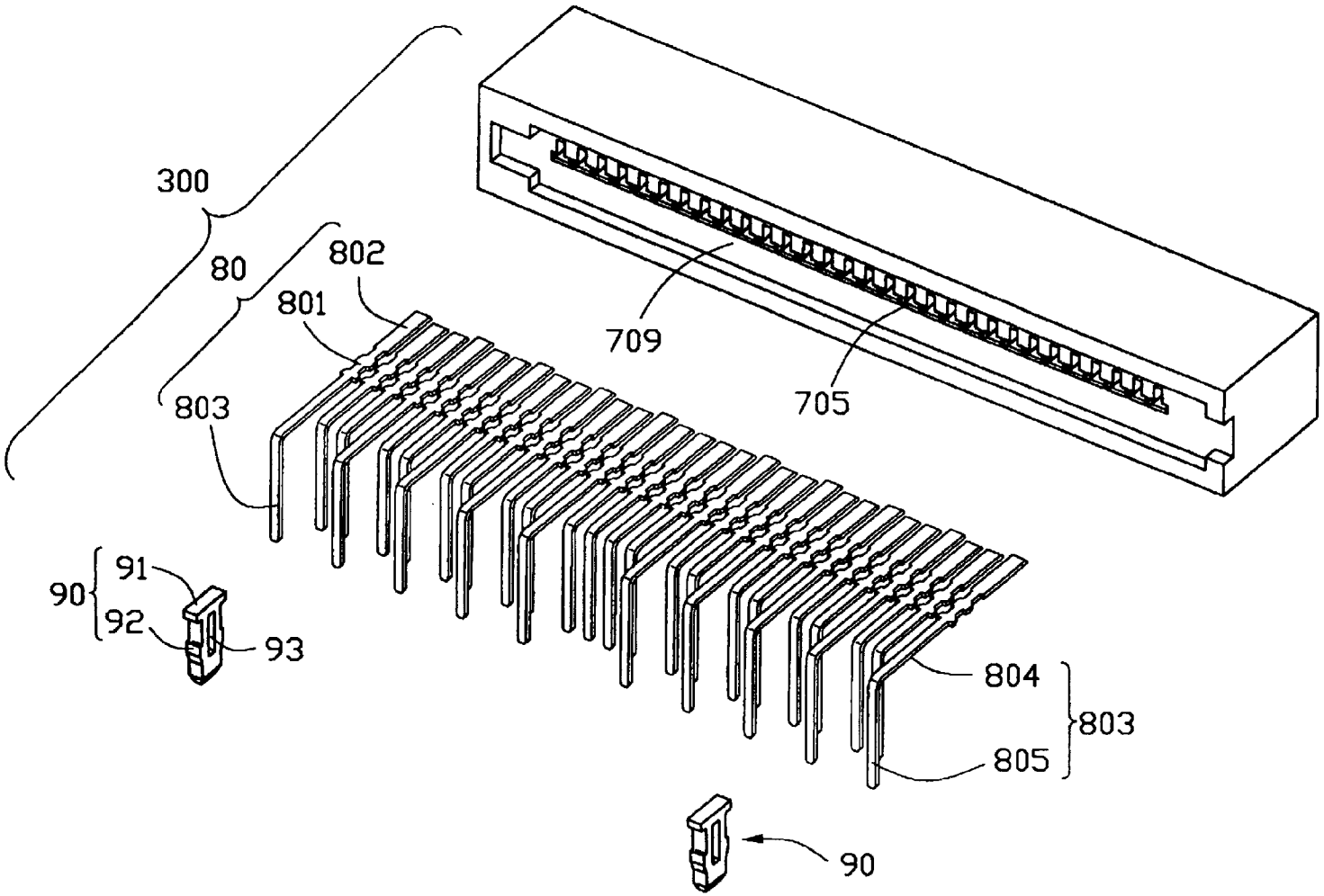
FIG. 2 is a view similar to FIG. 1, but taken from a rear aspect.
Figure 3:
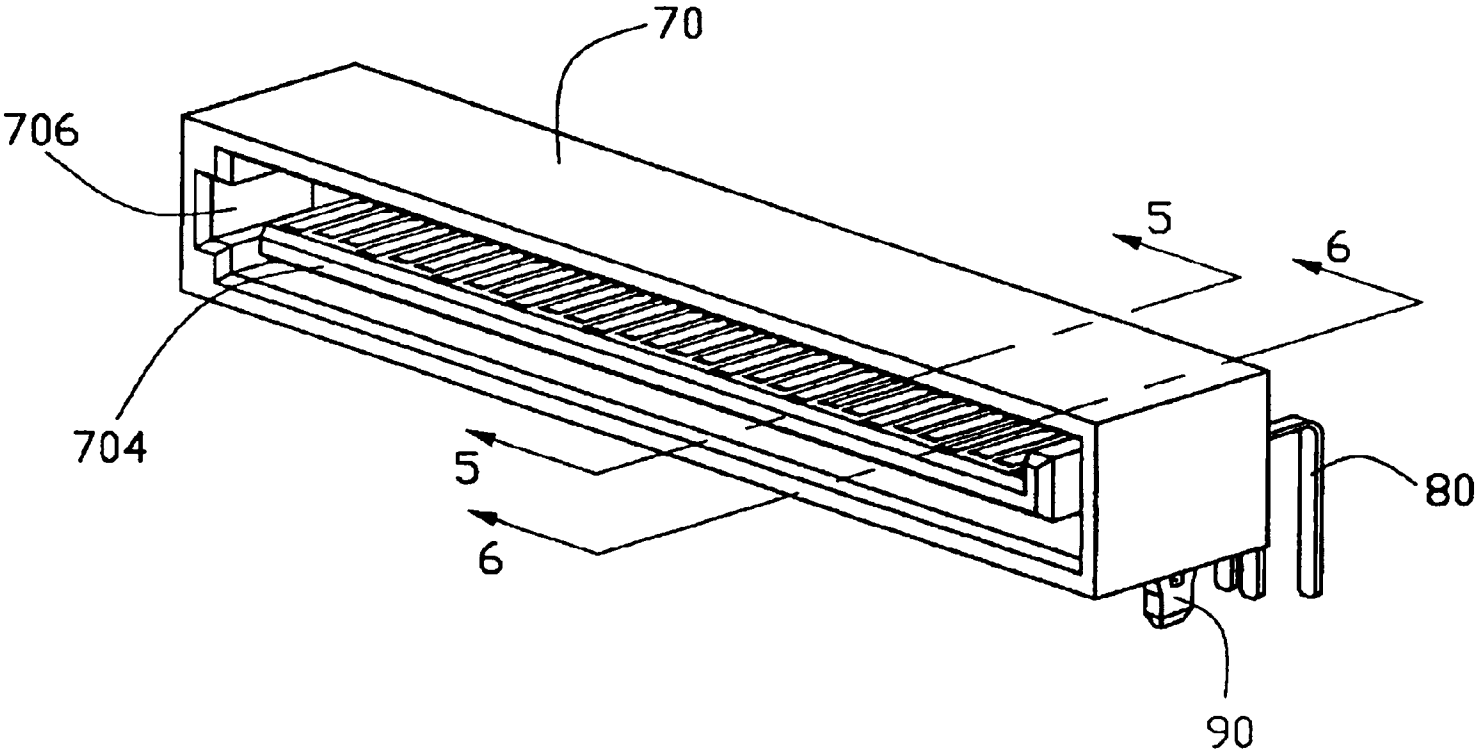
FIG. 3 is an assembled perspective view of the SATA connector of FIG. 1.
Figure 4:
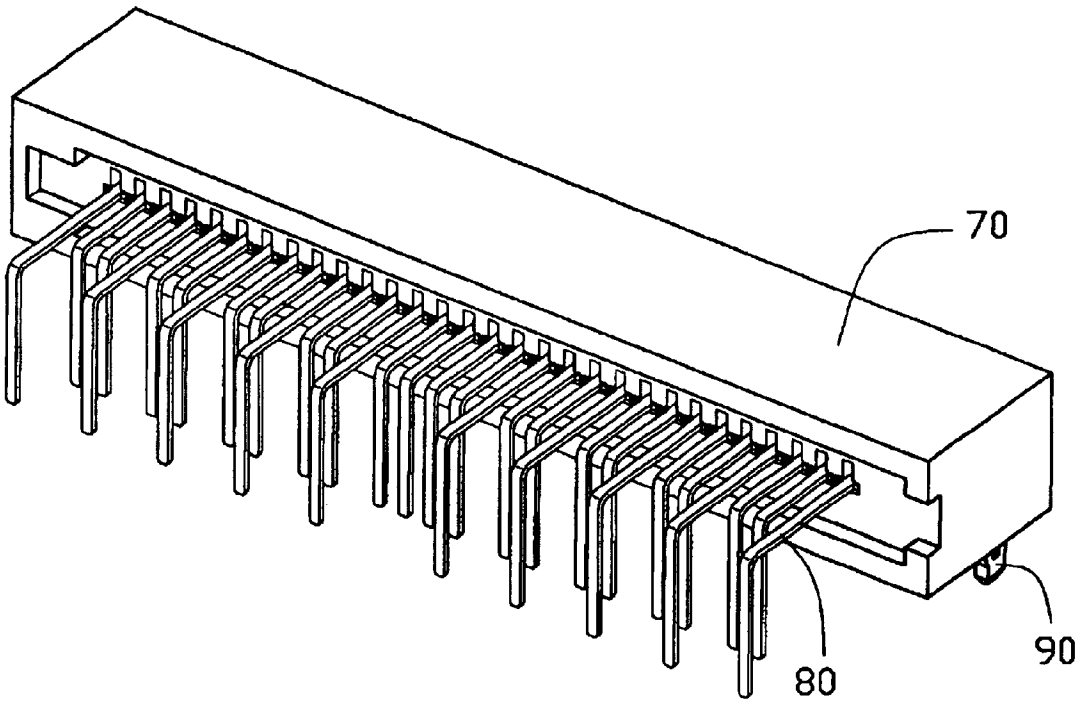
FIG. 4 is a view similar to FIG. 3, but taken from a rear aspect.
Figure 5:
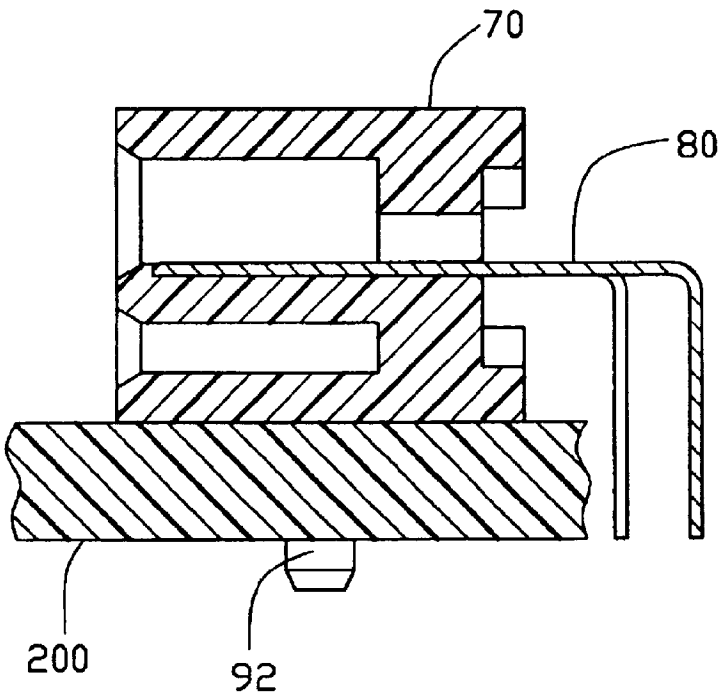
FIG. 5 is a cross-sectional view taken along line 5—5 of FIG. 3 showing the SATA connector to a printed circuit board (PCB)
Figure 6:
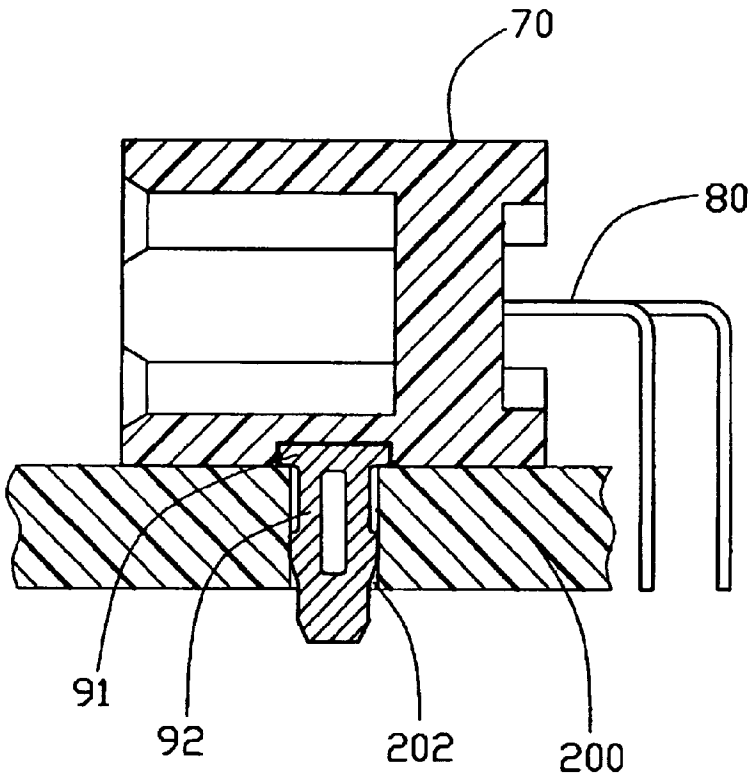
FIG. 6 is a cross-sectional view taken along line 6—6 of FIG. 3 showing the SATA connector to the PCB.

Referring to FIGS. 1 and 2, a SATA connector 300 comprises an insulative housing 70, a plurality of right angle contacts 80, and a pair of board locks 90.

The insulative housing 70 comprises a top wall 700, a bottom wall 701, a pair of side walls 702 and a rear wall 709 which together defines a mating space 703, an L-shaped tongue 704 extending from the rear wall 709 and into the mating space 703. A plurality of passageways 705 is defined in a top face of the L-shaped tongue 704 and extending through the rear wall 709, a slot 706 is defined in a side wall 702 and communicating with the mating space 703.

Each right angle contact 80 comprises a securing portion 801 at a middle thereof, an engaging portion 802 extending forwardly from the securing portion 801, and a solder portion 803 extending rearward from the securing portion 801 and bent in a right angle. The solder portion 803 comprises a leg portion 804 directly extending from the securing the portion 804 and a foot portion 805 bent in a right angle from a end of the leg portion 804. The plurality of contacts 80 separately transmits high speed signals, grounding signals, and low speed signals or power. A length of the leg portion 804 of the contact 80 transmitting grounding signals is longer than a length of the leg portion 804 of the contact 80 transmitting high speed signals and low speed signals or power.

Each board lock 90 made of metal material comprises a mounting section 91 at a top thereof and a retaining section 92 below the mounting section 91. A through hole 93 is defined in a center of the retaining section 92 so as to increase flexibility of the retaining section 92.

Referring to FIGS. 3–6, in assembly, the contacts 80 are assembled into the housing 70 with each securing portion 801 assembled into a pair of side walls of the passageway 705, each engaging portion 802 received into the passageway 705 and exposed into the mating space 703, and the solder portion 803 extending beyond the rear wall 709 of the housing 70. The foot portions 805 of the contacts 80 are arranged in two rows with the foot portions 805 of the contact transmitting grounding signals positioning far away from the rear wall 709 of the housing 70 and the foot portions 805 of the contacts 80 transmitting high speed signals and low speed signals or power positioning close to the rear wall 709 of the housing 70. The pair of board locks 90 are assembled into the bottom wall 701 with the mounting sections 91 of the board locks 90 engaging with the bottom wall 701.

When the SATA connector is mounted to a Printed Circuit Board (PCB) 200, the foot portions 805 of the contacts 80 extend through a plurality of through holes 202 defined in the PCB and soldered thereon, the retaining sections 92 are received in the trough holes 202 of the PCB 200 with the retaining sections 92 interfering with inner walls of the through holes 202 so that the board locks 90 secure the SATA connector 300 to the PCB 200.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A Serial Advanced Technology Attachment (SATA) connector for being soldered to a printed circuit board (PCB), comprising:

an insulative housing a top wall, a bottom wall, a pair of side walls and a rear wall which together define a mating space, and an L-shaped tongue extending from the rear wall into the mating space;

a plurality of contacts each having an engaging portion retained in the L-shaped tongue and a solder pottion extending beyond the rear wall and bent in right angle so as to be parallel to the rear wall for being soldered to the PCB, a plurality of passageways is defined in the tongue and extending through the rear wall, and the contacts are received into the passageways, the contact has a securing portion locating between the engaging portion and the solder portion, the securing portion securing in the passageway, the solder portion of the contact comprises a leg portion extending from the securing portion and a foot portion extending from the leg portion and bent in a right angle so as to be parallel to the rear wall of the housing, the solder portions of the contacts are arranged in two rows, one row being close to the rear wall of the housing and the other row being far away from the rear wall of the housing, the connector further comprises a pair of board locks mounted to the bottom wall of the housing, the board lock is make of metal material, the board lock comprises a mounting section at a top thereof, which is assembled into the bottom wall of the housing, and a retaining section below the mounting section which is adapted for being mounted in the PCB.

* * * * *